United States Patent [19]

Chisholm

[11] 4,125,331

[45] Nov. 14, 1978

[54] MIXING APPARATUS

[75] Inventor: James P. Chisholm, Tulsa, Okla.

[73] Assignee: The Dow Chemical Company, Midland, Mich.

[21] Appl. No.: 794,876

[22] Filed: May 9, 1977

[51] Int. Cl.[2] ..... B28C 5/08; B01F 13/10

[52] U.S. Cl. ..... 366/21; 366/34; 366/136; 366/160; 366/165; 366/178

[58] Field of Search ..... 259/4 R, 161, 154, 162, 259/165, 150, 18, 153, 164

[56] References Cited

U.S. PATENT DOCUMENTS

| | | | |
|---|---|---|---|
| 3,201,093 | 8/1965 | Smith | 259/4 R |
| 3,256,181 | 6/1966 | Zingg et al. | 259/154 X |
| 3,741,533 | 6/1973 | Winn, Jr. | 259/4 R |
| 4,007,921 | 2/1977 | Zingg | 259/4 R |

*Primary Examiner*—George F. Mautz

*Attorney, Agent, or Firm*—V. Dean Clausen

[57] ABSTRACT

A mixing apparatus for the continuous mixing of a dry bulk material with a liquid to form a slurry. The dry material is introduced through an elongated vertical tube while the liquid is brought into an elongated cylindrical chamber around that tube in a rotary motion under pressure. The liquid with its rotary motion and being under pressure exits from an adjustable annular orifice at the same point that the dry bulk material is added to the slurry whereby the jetted liquid effects the initial mixing process while deflecting the material into a reservoir. The slurry thus formed is circulated by a suitable pumping system from the reservoir for use. The unused slurry is pumped back into the reservoir by way of a voluted shroud which envelopes the mixing portion of the initial mixing device. Centrifugal force resulting from this rotary motion of the slurry tends to pull the newly mixed slurry out into the reservoir for a continuous intimate mixing process.

4 Claims, 4 Drawing Figures

MIXING APPARATUS

BACKGROUND OF THE INVENTION

1. Field of the Invention

The present invention relates to an apparatus for a continuous mixing of particulate solid material with a liquid, and more particularly, but not by way of limitation, to a continuous cement mixing apparatus.

In oil and gas well applications it is often necessary to provide cement mixers which will rapidly prepare large quantities of material to be pumped into the well by a continuous process until a sufficient predetermined quantity has been applied. A paddle or rotary type mixer while being able to adequately perform the mixing operation requires a large volume and since the mixing must be done on site the bulk and weight of the equipment used is prohibitively expensive. Continuous monitoring of all such rotary mixing equipment must be made in order to insure that the slurry does not become so thick as to cause the paddles or rotary device to stick. The cleanup operation of the equipment after use can also be a severe problem in the field.

Jet type mixers function well in making ordinary cement slurries but the adequate mixing of gel cements has proven difficult with the jet type mixer. Also, the jet mixer usually requires the use of one of the treating pumps in order to drive the jet, thereby reducing the treating capacity.

In recent years vortex mixers of the type disclosed and claimed in U.S. Pat. Nos. 3,201,093 and 3,741,533 have been used with considerable success. However, the device of the first mentioned patent has an inherent problem in mixing dense slurries while the second mentioned patent having somewhat overcome the problem, has required the use of excessive horsepower in mixing the dry bulk with the liquid.

SUMMARY OF THE INVENTION

The present invention provides a vortex type mixing device to continuously mix dry bulk material with a liquid in order to form a slurry and which is particularly designed and constructed to overcome the above disadvantages. This apparatus provides for the dry material to be introduced through a vertical sleeve member which is surrounded by a vertical shroud in order to form a cylindrical annulus between the sleeve member and the shroud. The lower end of the shroud is tapered inwardly to form a somewhat truncated conical shaped outlet. The sleeve member utilized for introducing dry material is vertically movable within this shroud and in its extreme lower position contacts the inner walls of the truncated conical section of the shroud and can thereby provide a seal, e.g. a metal to metal seal, for prohibiting liquid from exiting the lower end of the shroud. In order to control the flow of liquid through the shroud into contact with the dry bulk material the sleeve for transporting the dry bulk material is raised by a hydraulic system out of contact with the lower end of the shroud thereby permitting a measured amount of liquid to mix with the bulk material while maintaining maximum liquid pressure.

The liquid enters the upper portion of the shroud surrounding the dry bulk sleeve member with a rotary motion and then by the force of gravity revolves helically downwardly through the shroud so that it mixes intimately with the dry material as said dry material exits the lower end of the sleeve member.

The centrifugal force due to the rotary motion of the liquid then throws the newly mixed material outwardly into a second shroud which envelopes the lower ends of both the movable sleeve member and first shroud. The second shroud is a rotary voluted chamber which is operably connected to the return line of the slurry mix. The unused slurry is circulated back into the return line and enters the second shroud with a rotary motion resulting in centrifugal force and prevents the already mixed slurry from splashing back into the point where the dry material is entering the system. Therefore, the newly mixed slurry and the return slurry enters the reservoir where it may be again pumped into the well head as needed.

By being able to control the water inlet orifice at the point of mixing with the dry material rather than upstream thereof, pressure can be maintained, thereby increasing the liquid velocity at the point of mixing such that the chances of the device clogging due to a dense slurry mix are greatly reduced. Further, since the liquid exits the orifice under high pressure, the power provided thereby goes into the mixing process thereby fully taking advantage of the available power which is usually limited.

DESCRIPTION OF THE DRAWINGS

Other and further advantageous features of the present invention will hereinafter more fully appear in connection with the detailed description of the drawings in which.

DESCRIPTION OF THE PREFERRED EMBODIMENT

Figure 1:
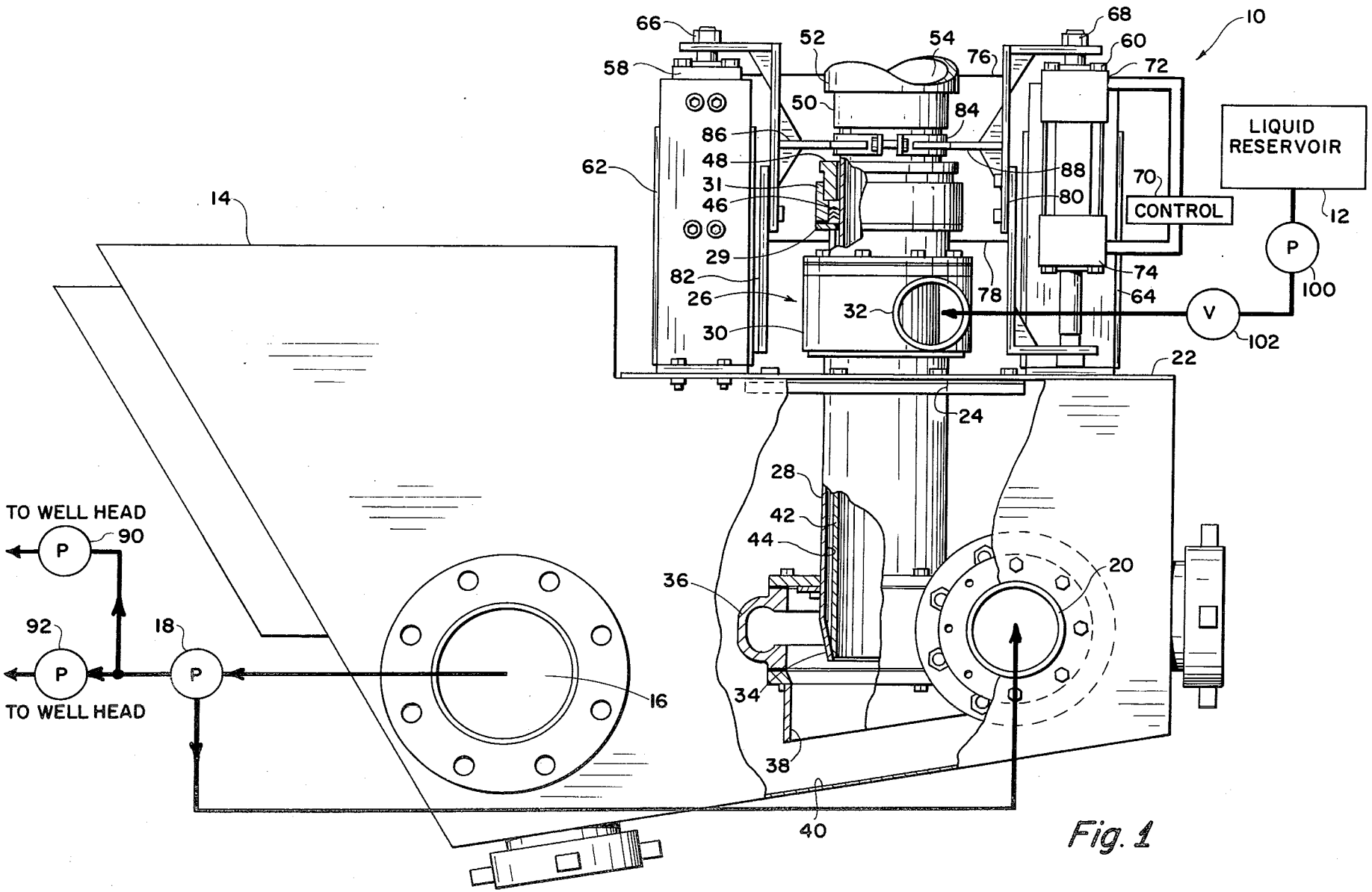
FIG. 1 is a partial sectional, front elevational view of a mixing apparatus embodying the present invention.

Referring to the drawings in detail, reference character 10 generally indicates a mixing apparatus which is primarily utilized for mixing a cement slurry of a predetermined density for use in oil and gas well cementing service operations. The device is normally mounted on a well servicing truck (not shown) which carries a supply of water or other suitable liquid in a liquid reservoir 12 and a supply of dry bulk cement material in the second reservoir (not shown). The device generally comprises a slurry reservoir 14 having a slurry outlet 16 in the lower portion thereof which is connected to a suitable slurry suction pump 18 having at least two outlets. The reservoir also contains a return inlet indicated by reference character 20 which is operably connected to one output of the suction pump 18 for a purpose that will be hereinafter set forth.

Figure 4:
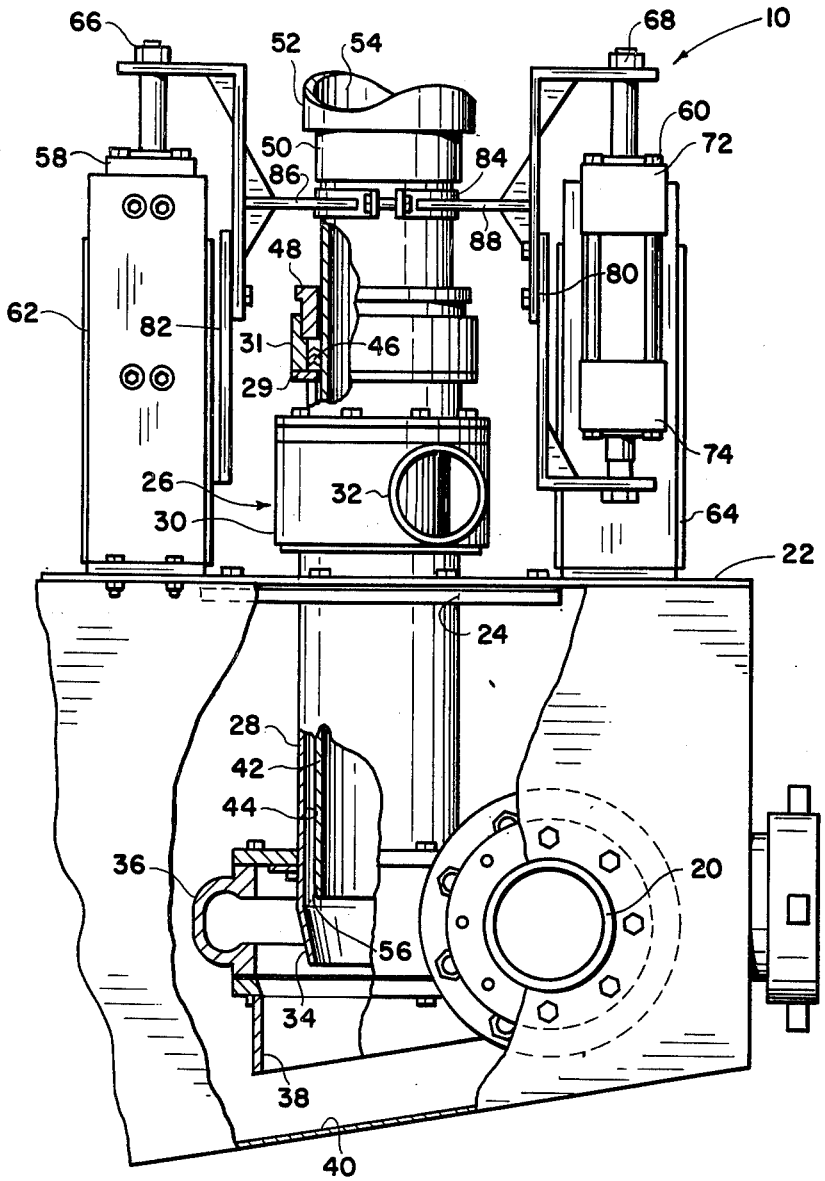
FIG. 4 is a sectional front elevational view of the device of FIG. 1 in a second operational position.

The upper portion of the reservoir is provided with a mounting plate 22 having a vertical port 24 therein, which can be more clearly viewed in FIG. 4, for receiving a vortex mixing apparatus generally indicated by reference character 26 therethrough. The vortex mixing apparatus comprises a vertically disposed shroud member 28 which extends downwardly through the port 24 into the inside of the reservoir 14. The upper portion of the shroud member 28 extends above the reservoir mounting plate 22 and is connected in open communication with a liquid inlet chamber 30. The upper end of the cylindrical shroud member 28 is provided with an outwardly extending flange 29 therearound which is in turn secured to a vertical collar 31 for a purpose that will be hereinafter set forth. The chamber 30 is of a flat cylindrical shape and is provided with an inlet port 32 at one side thereof creating a voluted chamber, the longitudinal axis of said inlet port 32 being substantially tanget to the cylindrical chamber 30 in order to create a swirling vortex motion of the liquid entering therein. The liquid inlet port 32 is connected to the liquid reservoir 12 by means of a pump 100 and valve 102 connected in series therewith.

The lower end of the cylindrical shroud member 28 is disposed within the reservoir and is tapered inwardly to form a truncated conic section 34 for a purpose that will be hereinafter set forth. A second voluted chamber, hereinafter referred to as the slurry return chamber 36 is located within the reservoir and completely surrounds the exterior of the lower end of the cylindrical shroud member 28. The chamber 36 is open at the bottom portion 38 with said opening portion 38 being spaced from the bottom of the reservoir indicated by reference character 40. The slurry return inlet 20 is connected in open communication with the interior of the shroud chamber 36 such that the center line axis of the return inlet 20 is tangent to the interior volute portion of the shroud member 36 in order to create a second voluted chamber creating a vortex motion of the slurry entering therein.

The dry material inlet comprises an elongated vertically disposed sleeve member 42 which is concentrically disposed within the elongated shroud member 28 thereby forming a cylindrical chamber 44 therebetween. The sleeve member 42 extends upwardly above the upper end of the shroud member 28 and its flange and collar members 29 and 31. The sleeve member 42 is reciprocally disposed within the shroud member 28 and is in sealing engagement therewith by means of a packing ring 46 which is supported by the flange member 29 at the upper end of the shroud member 28. A second cylindrical collar member 48 is threadedly engagable with the vertical collar member 31 in order to hold the packing ring 46 in place against the outside surface of the movable sleeve member 42. The upper end of the sleeve member 42 is provided with a suitable connection collar 50 for attachment to a flexible dry material inlet hose or the like 52, thus forming what will be hereinafter referred to as a dry material inlet 54.

The sleeve member 42 is of a diameter substantially equal to the diameter of the lower end of the conical portion 34 of the shroud member 28. The lower end of said sleeve member 42 is provided with an outer edge bevel 56 of an angle compatible with the angle of the conical section 34 of the sleeve member 28 whereby upon lowering the sleeve member 42 the bevel 56 engages the inside surface of the conical section 34 thereby substantially sealing the cylindrical chamber 44 at the bottom.

Means to raise or lower the sleeve member 42 is provided by a pair of matching hydraulic cylinders 58 and 60 which are securely mounted to the upper surface of the reservoir platform 22 by suitable mounting brackets 62 and 64 respectively. The hydraulic cylinders are mounted on directly opposite sides of the upwardly extending movable sleeve member 42. Each cylinder has common rods 66 and 68 respectively which extend completely through each cylinder and carries a piston (not shown) located inside the cylinder, dividing the cylinder into an upper and lower chamber. Referring to the cylinder 60 which is typical, a control means 70 is operably connected to an upper chamber 72 and a lower chamber 74 by suitable control lines. When fluid is forced into the lower chamber 74, the piston and associated rod 68 will raise. On the other hand, when fluid is pumped into the upper chamber 72 the piston and associated rod 68 will lower. The cylinder 58 is similarly constructed and is commonly connected to the upper and lower chambers of the cylinder 60 for simultaneous operation thereby by means of the lines generally indicated by reference characters 76 and 78. The rod 68 of the cylinder 60 is provided with a C-shaped bracket 80 connecting the ends of said rods 68 together. A second C-shaped bracket 82 connects the ends of the rods 66 together on the opposite side of the sleeve 42. The C-shaped brackets 80 and 82 are then connected to the sleeve member 42 by means of a clamp 84 and associated arm members 86 and 88. Therefore, when it is desired to raise sleeve member 42, fluid is pumped into the lower chambers of the hydraulic cylinders 58 and 60, thereby raising the associated piston rods 66 and 68 along with their C-shaped brackets 80 and 82. The brackets then transfer the lifting power to the sleeve member 42 by means of clamp 84. To lower the cylinder, a reverse procedure is applied thereby pumping fluid into the upper chambers of the hydraulic cylinders 58 and 60.

Figure 2:
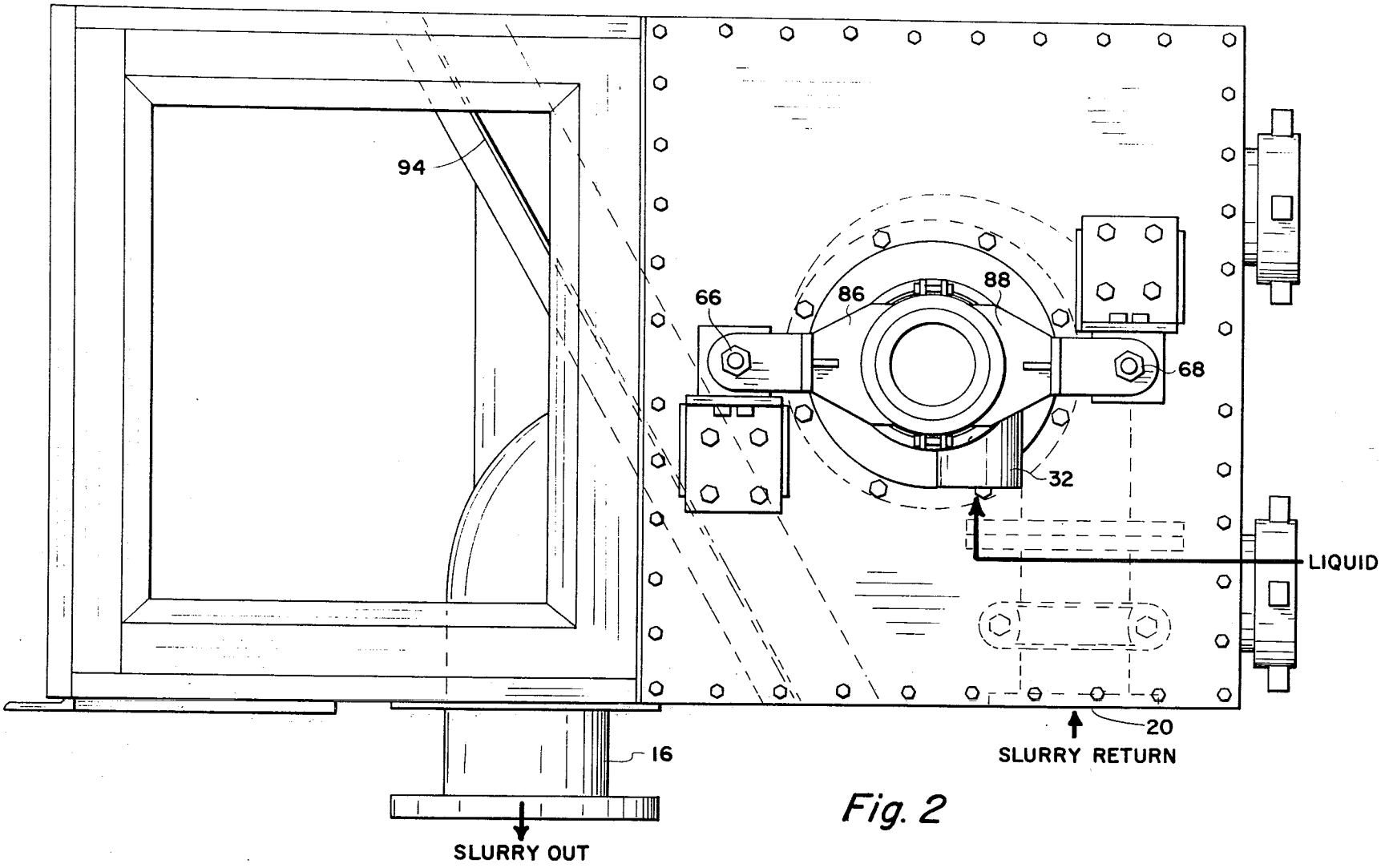
FIG. 2 is a plan view of the apparatus of FIG. 1.
Figure 3:
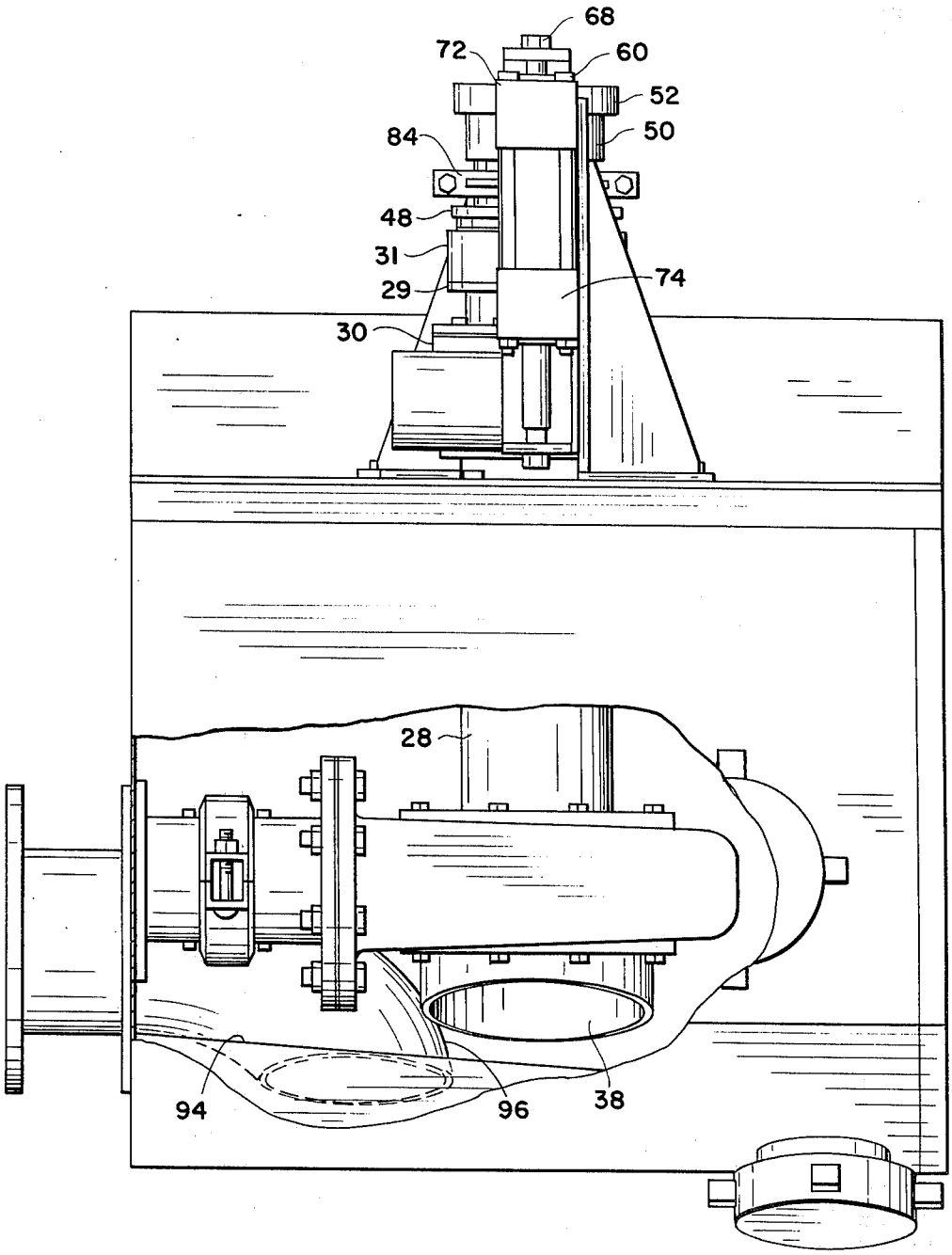
FIG. 3 is a side elevational view of the apparatus of FIG. 1.

Referring now to the reservoir 14, an elongated baffle member indicated in FIGS. 2 and 3 by reference character 94 extends completely across the bottom portion of the reservoir, thereby separating the slurry outlet port 16 from the outlet 38 of the vortex mixing device. The slurry outlet 16 is provided with an inwardly extending curved suction pipe 96 which is curved downwardly and open at the bottom end thereof in order to pick up slurry from the lower portion of the reservoir. The baffle 94 serves to prevent the newly mixed and returned slurry from being thrown directly into the suction inlet pipe 96. The slurry pump 18 while drawing slurry out of the reservoir 14 has the capability of either gating the slurry to a plurality of triplex pumps generally indicated by reference characters 90 and 92 or if those pumps are not operating at capacity or if the entire amount of slurry is not needed, the pump 18 may gate the slurry back into the return inlet 20. As the slurry enters the inlet 20 it moves into the voluted chamber 36 thereby setting up a swirling or vortex motion around the exterior of the lower ends of the shroud member 28 and the sleeve member 42.

In operation, liquid which is usually water plus additives is pumped from the reservoir 12 by means of the pump 100 through a valve 102, which is usually operated to a fully open position into the liquid inlet port 32. The liquid then travels around the interior of the cylindrical chamber 30 and circles around the dry cement inlet sleeve 42 therein. The liquid then by virtue of its velocity starts a helical spiralling motion downwardly through the cylindrical shaped chamber 44 between the shroud 28 and sleeve member 42 toward the bottom thereof. If the sleeve member 42 is in the fully lowered position as shown in FIG. 1, the liquid is cut off at that point and remains in the cylindrical chamber under pressure.

Dry cement or other particulated material enters the apparatus through the inlet port 54 and is pumped or allowed to fall directly down the inside of the sleeve member 42. This dry material is normally metered upstream and enters at a predetermined rate. Fluid may then be pumped into the lower chambers of the control cylinders 58 and 60 thereby raising the sleeve member 42 which provides an annular orifice at the bottom thereof between the lower end of the sleeve member 42 and the truncated conically shaped outlet 34 of the shroud member 28. The liquid exiting this annular orifice is still under pressure and exits with a high speed rotary motion. Although the lower end or conical shape portion 34 of the shroud 28 tends to direct the liquid inwardly, the rotary motion and the centrifugal force created thereby tends to force the liquid to swirl outwardly into the lower portion of the slurry return shroud 36. This outwardly swirling motion of the liquid picks up the dry particles, not only wets these particles but pulls them outwardly for intimate mixing with the liquid before exiting the mixing outlet chamber 38.

After the reservoir reaches a certain level of fill and passes over the baffle 94 in the bottom thereof the slurry pump 18 pulls the slurry out of the reservoir and provides it to the well head triplex pumps 90 and 92. Any slurry which is not taken by the triplex pumps 90 and 92 will be recirculated out of the slurry pump 18 back to the return inlet 20 where it is forced into a rotary motion within the voluted shroud 36 surrounding the lower ends of the liquid and dry material inlets. The centrifugal force due to the rotation of the return slurry causes the return slurry to be forced against the chamber walls and helically moved down through the chamber 38. Since the return slurry is contained against the walls of chamber 38 it will not splash back into the dry material inlet which could cause clogging of the mixer. This rotary motion of the slurry also serves to help intimately mix the dry material and liquid which are forced outwardly by their centrifugal force into mixing with the return slurry. This previously mixed slurry and the new mixed slurry is then taken into the reservoir for repumping by the slurry pump 18.

In normal operation the liquid inlet valve 102 is fully opened and control of the liquid volume is solely by means of the position of the vertical sleeve 42 within the shroud 28. This permits the liquid therein to be under pressure throughout the entire inlet process thereby causing it to exit the lower end of the shroud 28 with a high rotational velocity to facilitate intimate mixing with the dry material.

From the foregoing it is apparent that the present invention provides a vortex type continuous mixing apparatus whereby more efficient mixing occurs since the liquid inlet is maintained under pressure at all times until the point where it mixes with the dry material.

Whereas, the present invention has been described in particular relation to the drawings attached hereto, other and further modifications apart from those shown or suggested herein may be made within the spirit and scope of the invention.

What is claimed is:

1. An improvement in a slurry mixing apparatus for continuous mixing of dry bulk material and liquid, and having an elongated vertically disposed dry material passageway open at the bottom end thereof, a liquid inlet chamber surrounding the upper portion of dry materials passageway, the top of said inlet chamber being closed to the dry materials passageway, an elongated vertically disposed shroud member surrounding the dry material passageway and providing communication between the liquid inlet chamber and the bottom of the dry materials passageway, the improvement comprising:

adjustable closure means provided at the lower end of the shroud member adjacent the lower end of the dry material passageway for controlling the liquid flow discharging therefrom.

2. A mixing apparatus as set forth in claim 1 wherein the liquid inlet chamber is provided with a tangential inlet port to impart a circular movement to the incoming liquid.

3. A mixing apparatus as set forth in claim 2 wherein the dry material passageway is of substantially cylindrical configuration and wherein the shroud member is of substantial cylindrical configuration concentrically surrounding the dry material passageway, forming an annulus therebetween, the lower end of said shroud being inwardly tapered, means for reciprocally moving said dry materials passageway for positioning the lower end thereof with respect to the inwardly tapered portion of the shroud member for providing an adjustable annular orifice.

4. A mixing apparatus as set forth in claim 3 wherein the means for reciprocally moving the dry material passageway comprises hydraulic means operably connected to the upper end of said dry material passageway.

* * * * *